United States Patent [19]

Stannard

[11] Patent Number: 4,522,618

[45] Date of Patent: Jun. 11, 1985

[54] MECHANISM FOR ASSEMBLING TAPERED, NESTED CONTAINERS

[75] Inventor: Charles G. Stannard, E. Granby, Conn.

[73] Assignee: Sprinter Systems Incorporated, East Windsor, Conn.

[21] Appl. No.: 366,569

[22] Filed: Apr. 8, 1982

[51] Int. Cl.[3] ..... B31B 1/44; B31B 1/62; B31B 1/98

[52] U.S. Cl. ..... 493/143; 493/130; 493/174; 493/336

[58] Field of Search ..... 493/143, 142, 130, 128, 493/131, 171, 174, 167, 336, 331, 10, 23

[56] References Cited

U.S. PATENT DOCUMENTS

| | | | |
|---|---|---|---|
| 1,965,274 | 7/1934 | Zanetti | 493/128 X |
| 2,551,186 | 5/1951 | Veyret et al. | 493/144 |
| 2,789,481 | 4/1957 | Palmer | 493/128 X |
| 2,846,930 | 8/1958 | Gross | 493/128 |
| 2,929,302 | 3/1960 | Brown | 493/174 X |
| 3,115,073 | 12/1963 | Kreimendahl | 493/128 |
| 3,986,440 | 10/1976 | MacDonald et al. | 493/10 X |
| 4,289,491 | 9/1981 | Collura et al. | 493/143 X |

*Primary Examiner*—James F. Coan

[57] ABSTRACT

Apparatus for forming a tapered, nestable leakproof container having a bottom wall integral with front and back panels and side panels and a triangular connecting panel between additional panels extending from the front and back panels and the side panels, wherein the apparatus comprises a die and a tapered mandrel for forcing a blank through the die. The container blank is positioned on a support immediately above the die and held in position by guides on the support. Before the tapered mandrel engages the blank, glue is applied to the outer edges of the side panels of the rear wall of the container at the inner surfaces adjacent the outer edges of side panels connected to the rear panel and at the inner surface adjacent the outer edges of the side panels. The blank is forced into the die by the tapered mandrel. Appropriate pressure rollers resist the entry of the mandrel and move outwardly as the mandrel moves into the die moving the blank into the die. These pressure rollers engage firmly against the outer surfaces of the sections of the blank to which the glue has been applied and provide resilient pressure in order to squeeze and spread the glue and to press the glue into formation. The die is thus not a rigid die, but one which may yield to and follow the tapered form of the mandrel. Additional pressure rollers may be provided for the portions of the die engaging the front and back walls of the blank in order to provide firm guidance for the blank. The blank, after being pushed through the die, drops down and is delivered to the user's conveyor.

2 Claims, 13 Drawing Figures

11
16
17
18
19
70
71
72
73
75
76
77
78
41a
331A
330
331
411
411A
40
41
100
412
413
415
416
417
420
430
431
432
433
434
12

MECHANISM FOR ASSEMBLING TAPERED, NESTED CONTAINERS

BACKGROUND OF THE INVENTION

The present invention relates to devices for folding up and securing a container by a simplified means which includes a mandrel and a die opening which, when the blank for the container is placed appropriately over the die opening, cooperates so that the movement of the mandrel toward the blank and into the die opening causes the erection and completion of the container. The container preferably is of a type that has a flat bottom with front and rear walls extending therefrom and opposite each other and side walls extending therefrom at 90° to the front and rear walls. All of the walls are tapered so that they increase in size toward the opening of the container from their juncture with the bottom wall to a wider open mouth.

The front and rear walls have side panels which may be glued to each other and to the side panels extending from the bottom wall in order to complete the container. The container itself thus becomes a tapered frusto-tetrahedron having a smaller bottom wall than the opposite opening. These containers may be nested.

The device of the present invention is so arranged that when the container is completed by having it forced through the die by the mandrel, the glue having been applied in appropriate places beforehand, the container will drop down on a moving belt which will tip the container so that its bottom end is directed in the direction of movement of the belt and the belt will then drive the container toward other containers which have been similarly directed and which have been halted by a stop bar so that the container will nest with the last of the previous containers producing a complete series of nested containers which may be removed as a group.

Most frequently, such containers are utilized by fast food outlets or stands in theaters for the purveying a product, such as popcorn, or other products which may readily be filled into such containers by using the container as a ladle itself or by other means of filling the container wherein it is possible that certain liquids, such as the butter added to popcorn, may leak. Hence, the side walls of the container above referred to and the side panels extending from the front and back walls are connected by triangular sections located between them which form triangular gussets which are folded in as the container is formed in order to provide an integral closure for the bottom wall and to prevent any leakage of any nature whatsoever.

The machine for erecting the container to which this invention is directed comprises a stack storing means for the blanks, the blanks being so arranged so that they are either delivered toward the bottom of the stack and held there by gravity or by any equivalent force. The bottom of the stack need not necessarily be parallel to the floor but is simply the end of the stack from which the successive blanks are taken. They may be at some angle to the floor and may even be horizontal as long as means are provided for exerting appropriate pressure on the stack to cause it to bear against a bottom support and with means provided for inserting additional blanks as the need arises.

The bottom of the stack is supported by a framework which engages outer portions of the lowermost blank in the stack to permit the blank to be withdrawn. Preferably, a vacuum pick-up for the bottom blank is provided rotating through approximately 90° or more from the bottom of the stack to a position above the die opening through which the blank is forced to be formed. The blank is pulled off the bottom of the stack by the vacuum pull causing the edges of the blank to slip off the support and permitting the next blank to be engaged by the stack support. The vacuum support then rotates to a position where the blank is just above the die opening and the vacuum is released to permit the blank to drop appropriately oriented over the die opening.

The male mandrel which extends above the die opening at a distance above the die opening so that it will not interfere with the placement of the blank as the vacuum pick-up for the blank moves back toward the bottom of the stack for the next blank, moves down to force the blank through the die opening with appropriate compressing and guide means being provided along the sides of the die opening.

Prior to the engagement of the mandrel with the blank, a set of glue applicators on each side apply glue to the side panels of back wall of the blank on both sides in a manner herein specifically described. And also apply glue to the side walls. Then, as the glue applicator moves out of position with the vacuum pick-up moving back toward the next blank, the male mandrel comes down forcing the blank through the die. The pressure on the sides of the die helps to guide the blank firmly but resiliently but also exerts sufficient pressure to spread the glue and cause the glue to adhere to adjacent panel walls in order to complete the formation of the blank.

The blank is thereby folded up into substantially rectilinear condition with, however, all walls preferably flaring from the bottom wall and is dropped down, as above pointed out, on a conveyor which causes the blank to tip its bottom wall in the direction of movement of the conveyor, thereby moving the carton toward the stalled set of nested cartons for insertion into the topmost of the nested cartons. In this case, the nested cartons are lying on their side and the topmost end is extending substantially normally to the belt so that the carton which is formed is automatically inserted into this topmost nested carton.

As the length of nested cartons grows, the batch of cartons is removed. The stalling means may be any suitable bar or wall which will cause the box to stop while the belt moves with respect thereto.

The die itself, while it has a rectangular opening through which the blank is forced, is necessarily so arranged that it may control the blank and receive the blank as it is being formed into the frusto-tetrahedral shape which is narrower at the bottom and wider at the top. For this purpose, a pair of compression rolls are used at the portion of the die which forms the container so that the glue may be subject to appropriate pressure as the blank is being formed and forced therethrough, but, nevertheless, the blank may be completely controlled, first, as the narrow or bottom end enters and then as the wider and flaring upper portions pass through.

A pair of additional spring biased rolls may be provided in the die for the front and back walls so that the effective size of the die, as determined by the roll, will vary appropriately to fit both the blank as it is being formed and the mandrel.

Thus, as the mandrel comes down onto the blank and forces it through the die, the front and back walls of the die are folded up and then the side walls of the die are folded up, owing to the arrangement of the mandrel and the arrangement of the die, with the side walls being folded up on the outside of the front and back walls and being appropriately adhesively secured thereto.

Additional front and back wall rollers may be utilized, biased against the other two sides of the die in order to maintain complete control.

In the operation of the device, the blank, when first delivered to the die, is delivered on a support platform section, or trestle, somewhat above the die. The glue is applied when the blank is thus delivered and as the blank pick-up member moves out of the way toward the next blank to be picked up providing clearance for the mandrel as well. The glue having been applied and the blank pick-up being out of the way, the mandrel starts down.

The support for the blank may comprise relatively narrow support members defining essentially a support structure along the edges of the blank. In addition, folding guides are provided in connection with the support structure so that as the blank is forced down into the die, the folding guides which extend somewhat into the path of movement of the blank, but not so far as to interfere with the movement of the mandrel engage the triangular connection panels on each side between the side panels of the front and back wall and the side panels to direct them inwardly to form the bottom seal.

SUMMARY OF THE INVENTION

In summary, therefore, the present invention contemplates a machine for forming the tapered, nestable, leakproof container wherein a blank is delivered from a blank stack to a support just above a die and, as the device for delivering the blank from the stack to the support moves out of the way, glue is applied to the appropriate edges of the blank and a mandrel or male member comes down pushing the blank through the die. Since the blank is so formed that the carton to be formed has tapered walls, the mandrel has a frusto-tetrahedral shape matching that of the carton. The die is itself not merely an opening with specific boundaries, but a rectangular opening with compression rollers on each of the four sides biased toward the center of the opening and limited in their movement fully toward the center of the opening so that the blank and the mandrel may enter.

As the mandrel with its tapered sides enters, the die, in essence, must change its form and this is accomplished by the mandrel and blank forcing the compression rollers to move outwardly. The folding guides are not in the path of movement of the mandrel but are in the path of movement of the blank as it is initially pushed down so that they engage the connection between the folding panels and the side extension of the front and rear panels in order to guide the fold lines thereof inwardly. The sequence of movement is such that the side panels then end up at the outside of the carton and a complete nestable tapered carton is provided.

OBJECT OF THE INVENTION

The primary object of the present invention is to provide a simplified device for forming a tapered nestable open top carton.

A further and corollary object of the present invention is the provision in such a mechanism or machine of a die having compression rollers defining the opening of the die and movable away from the center of the die in accordance with the requirement that the die be used as part of the elements which form a tapered carton. The mandrel is tetrahedral in form, but terminating at its bottom end at a flat bottom substantially matching the bottom of the carton.

A further object of the present invention is, therefore, also to provide a substantially rectangular die having a variable dimension so that it may accommodate a tapered tetrahedral mandrel movable thereinto in order to form up a tapered carton from a blank.

A further object of the present invention is the provision for a simplified means for transport of the blank to the die position and for transport of the finished carton to a stacking position.

A further object of the present invention is the provision of simplified means for controlling the movement of the various wall portions of the carton in appropriate sequence so that appropriate gluing can be obtained and a completed carton completely sealed at its bottom may be obtained.

The foregoing and many other objects of the present invention will become apparent from the following description and drawings.

DETAILED DESCRIPTION OF A PREFERRED EMBODIMENT

Figure 5:
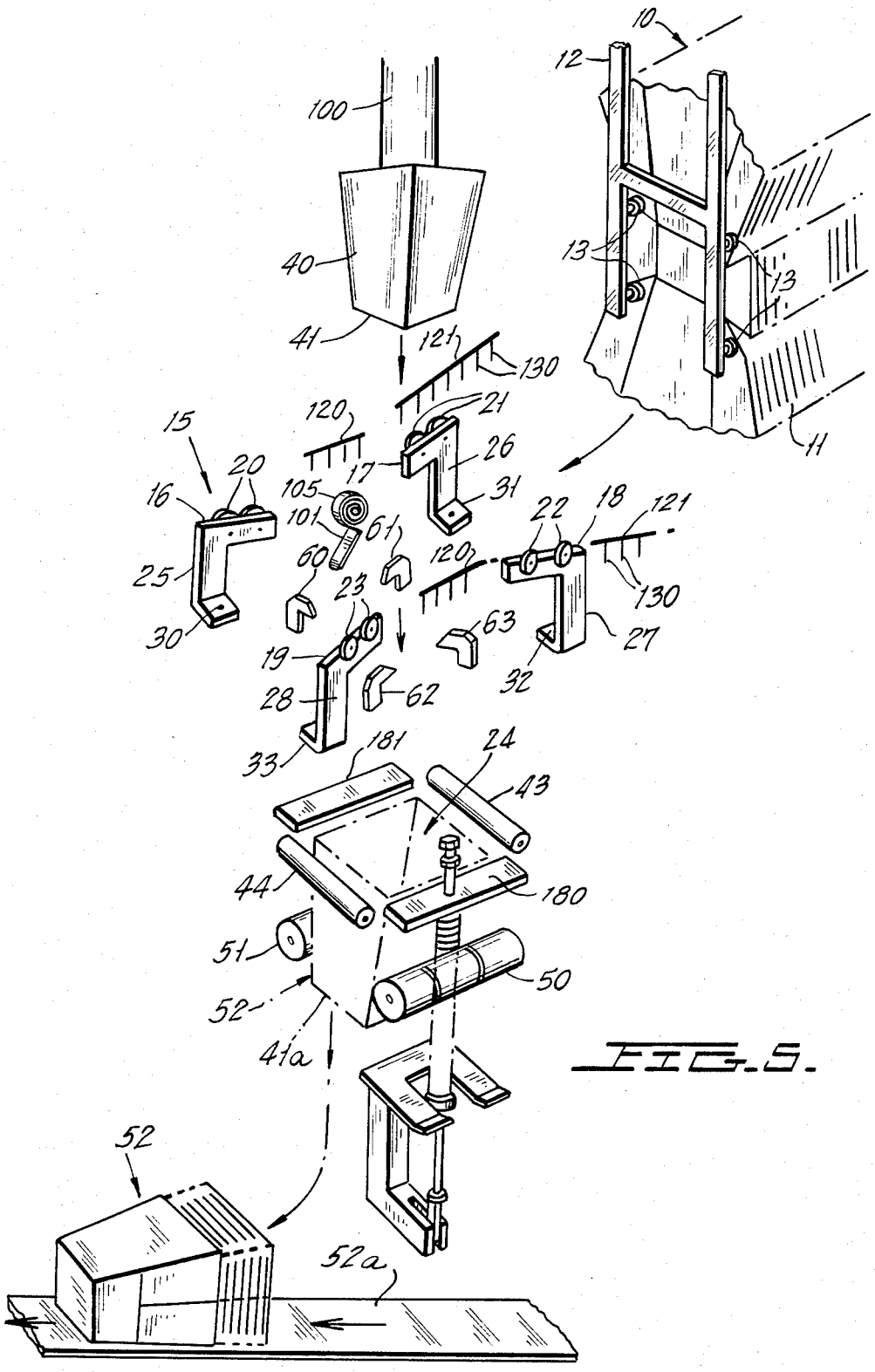
FIG. 5 is a schematic view showing only the operating elements (except for the glue applicators) broken out and with the support elements removed in order to illustrate the basic operation of the present invention.

Referring first to FIG. 5, the operation of the present invention can be shown schematically. A stack 10 of individual blanks 11 is supported in any suitable manner in a stacked arrangement. This is accomplished by providing a framework or other support which engages the bottom blank adjacent its edges without extending into the center of the blank itself. A vacuum operated blank pick-up 11 having a main frame 12 and vacuum pick-up elements 13, 13 engages the bottom blank of the stack which, as above pointed out, may actually be virtually on its side and at least inclined to the plane of the operating platform hereinafter described, and rotates to drop the bottom blank 11 of the stack on a support framework 15 which comprises a plurality of support surfaces 16, 17, 18, 19 and side guide members 20, 21, 22, 23 to position the blank above the die opening 24.

The support surfaces constitute a skeletal framework defining parts of the edge of the blank and thereby providing such support as is needed to maintain the blank above the die opening 24 without constraining the blank in any way, although it does position the blank accurately.

The support surfaces are supported on vertical supports 25, 26, 27, 28 which, in turn, are supported by the lower members extending at right angles thereto 30, 31, 32, 33 and are secured to the main base plate 35 of the machine. After the blank 11 is deposited on the supports 16, 17, 18, 19, the mandrel 40 which is tetrahedral in form but has a flat bottom 41, moves down to the blank to force the blank through the die in the manner shown particularly in FIG. 3.

Since the mandrel 40 is tapered in shape, the die 24 cannot be a rigid die, but, nevertheless, must provide full control. Hence, the front and back portions of the blank are controlled in their position by the rollers 43, 44 which are biased toward the center of the die opening 24 but constrained to their original position substantially permitting the lower end 41 of the mandrel to enter the die area. The side sections of the die are controlled by the pressure rollers 50, 51 which not only control the movement of the blank as it is forced down into the die by the mandrel, but also serve to provide sufficient pressure to complete the gluing operation. The blank, after it is forced through the die, falls down to the position shown at 52 where a conveyor may be provided, moving the blank into nested arrangement with other blanks which have been halted at the conveyor.

Rollers 43, 44 are biased toward the front and back of the box. Additional side guides 180, 181 are provided biased toward the mandrel and controlled as to their depth of movement by an adjustable rim 185 on the dependent extension 186 on each of the side guides 180, 181.

Figure 4:
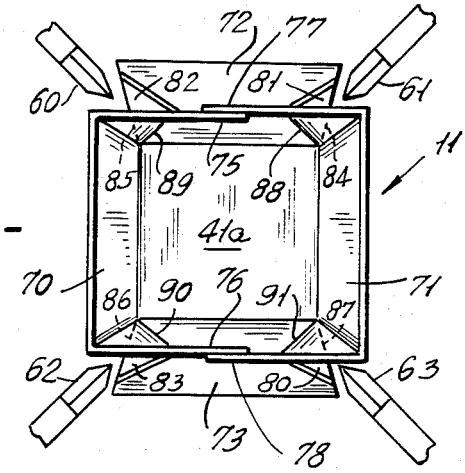
FIG. 4 is a view taken from line 4—4 of FIG. 3 looking in the direction of the arrows and showing the blank being folded up with the guide members guiding the additional triangular panel in its proper orientation in order to permit the complete sealing of the container.

The corner guides 60, 61, 62, 63 are provided so that they may engage the corner sections of the blank hereinafter described in a manner shown particularly in FIGS. 3 and 4 so that, as the blank is pushed down through the die, these corner sections are guided to fold inwardly. While the blank may, because of the movement of the mandrel with respect to the die and the other elements of the machine, fold up in the manner shown in FIGS. 3 and 4, the presence of the corner guides 60, 61, 62, 63, as shown, ensures that such folding up and the appropriate tucking in of the triangular panels of the blank will occur.

Figure 6:
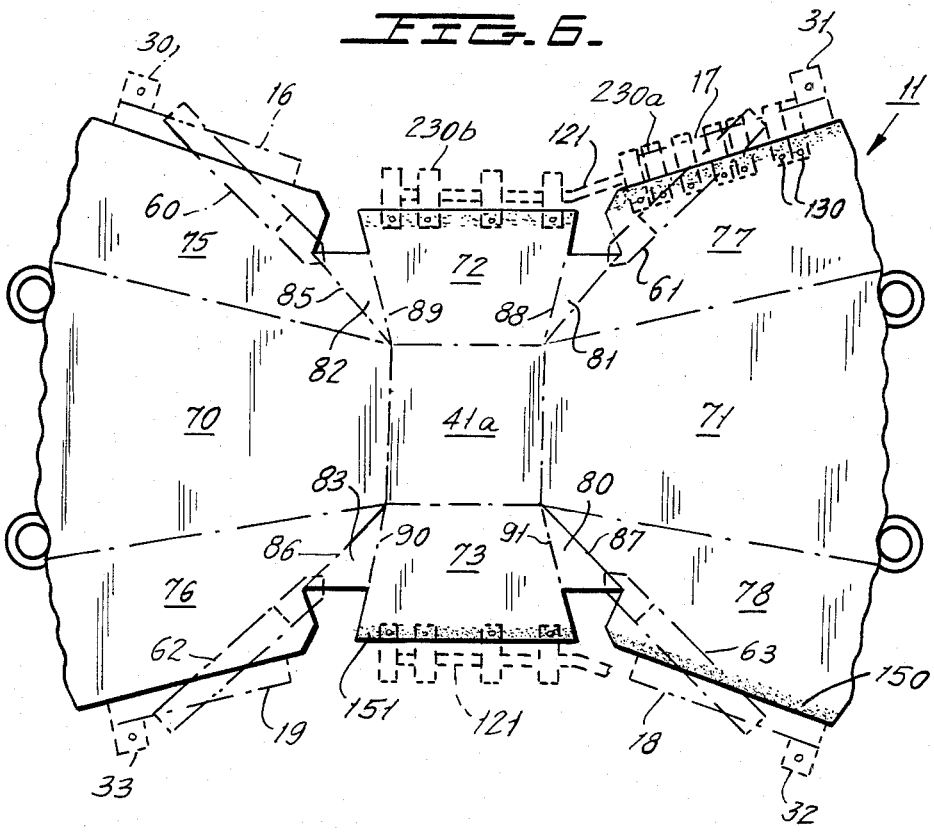
FIG. 6 is a plan view of the basic blank of the present invention showing, in diagrammatic form, the blank having been dropped and position on the support just above the die.
Figure 7:
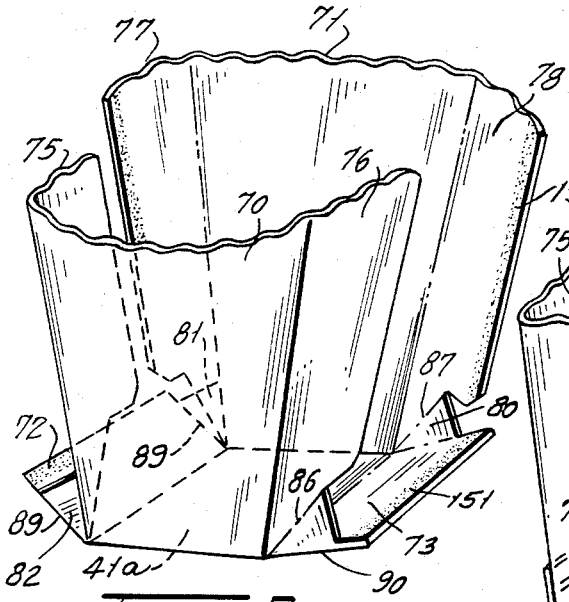
FIG. 7 is a view in perspective corresponding substantially to FIG. 4, showing the blank partially folded into carton position.

As seen in FIG. 6, the blank, for purposes of description and not necessarily orientation of the blank itself, comprises a front wall 70, a rear wall 71, side panel 72, side panel 73 and bottom wall 41*a* which matches the bottom 41 of the mandrel 40. The front and rear walls 70, 71 are each provided with side panels 75, 76 for the front panel and 77, 78 for the rear panel 71. Triangular panels 80, 81, 82, 83 are provided between, respectively, panels 77–72, 72–75, 76–73, 73–78 and are connected, respectively, to the side panels by fold lines 84, 85, 86 and 87, being connected thereby to the respective panels 77, 75, 76, 78 and are connected also by fold lines 88 to side panel 72, 89 to side panel 72, 90 to side panel 73 and 91 to side panel 73. The folding guides 60 to 63, as shown particularly in FIG. 4, cause the blank to fold up in the manner shown in FIGS. 3, 4 and 7 with the triangular interconnecting panels 80 to 83 folding inward and, as shown in the completed box of FIG. 8, forming a bottom leakproof seal.

The device is not shown as adjustable, owing to the fact that the die opening and especially the mandrel are not readily adjustable. It is possible, however, by making the mandrel removable from its vertically reciprocal driving post 100 and by adjusting the position of the rollers 43–44 and 50–51, to adjust the machine so that a different size box may be introduced. This would require, also, an adjustable mounting of the support member 15 and of the guides 60–63. In the usual case, the machine is manufactured to make a single size of carton. If the customer requires different sizes of carton, for production purposes, he prefers to have three machines making the three different sizes simultaneously so that the different sizes of cartons may be formed efficiently without any special changes in the machine. The introduction of adjustable elements in the machine in order to make it operable for different sizes of cartons is feasible, but the production of cartons of this type are generally full shift types of production, and the utilization of three machines for the usually required three sizes of cartons is preferred. The elimination of means for adjustment to various sizes of carton thereby eliminates substantial cost in the machine and makes the machine easy to operate and foolproof in operation.

Figure 8:
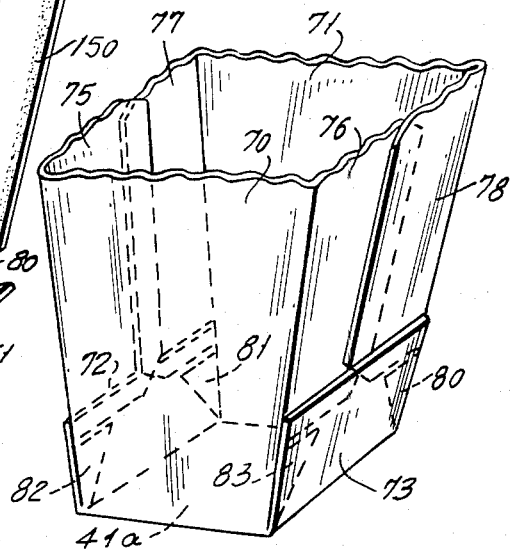
FIG. 8 is a view in perspective of the carton formed by the machine and process of the present invention.
Figure 8A:
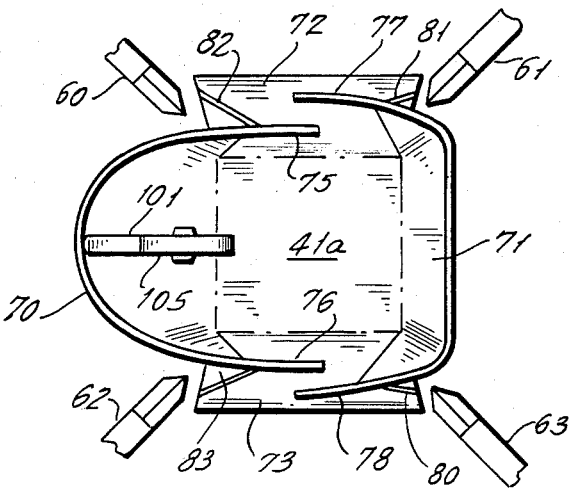
FIG. 8*a* is a schematic top view showing the method and order of folding of the sides of the carton.

It is obvious, that in order to form the blank of FIG. 6 into the carton of FIG. 8, glue application is needed. Various methods have been used for applying glue to appropriate portions of cartons in order to maintain their erected position. Such methods of applying glue are not part of the present invention. However, an exemplary method is included herein which includes certain novel elements, as herein described, owing to the character of the machine itself.

When the transfer device 12 is moving back for vacuum engagement with the next blank to be formed and, before the mandrel 40 starts down, a glue applicator 110 mounted on the platform 111 is operated. In this instance, as shown, the operation of the glue applicator is by means of a crank arm 112 attached to a rotational surface 113 rotating on the axis 114 and driven by the chain 115. The chain 115 is provided with a spring return. The glue applicator itself comprises the rod 120 and which also has a section 121. The rod 120 is angled in such manner that it coincides with the outer edge of the extension panel 77 of rear wall 71. A similar glue applicating device is also provided for the outer edge of extension panel 78 of rear panel 71. The section 121 of the glue applicator coincides with the outer section of side panel 72 and a duplicate on the other side also coincides with the outer edge of side extension 73. It will be noted that glue is applied to the outer edges of panels 77, 78, 72 and 73.

The method of application of the glue is that the operation of the chain in one direction causes, first, the applicator carrier 120, 121 to rise from a bath of glue 125 in which the glue applying rods 130 carried thereby are dipped at all times to stay above the bath of glue momentarily while the glue drips off and then to be moved over the outer edges of panels 77, 72 on one side for one applicator and panels 78 and 73 on the other side for the other applicator and move down so that glue is applied in spots as indicated at FIG. 6.

Figure 3:
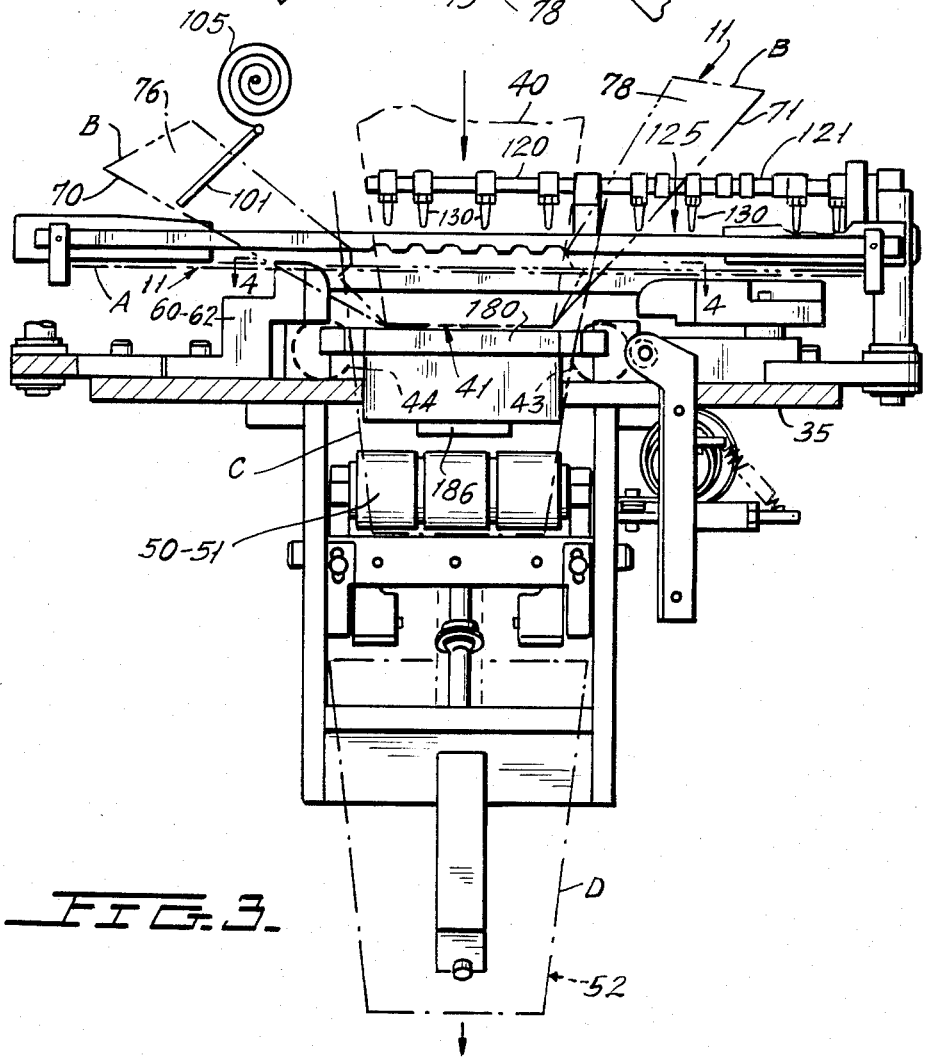
FIG. 3 is another view of the main portion of the machine taken from line 3—3 of FIG. 1 looking in the direction of the arrows showing the compression rollers below the die opening and the mandrel partially inserted in the die opening with the blank beginning its fold.

The glue applicator, as seen also in FIG. 3, comprises a number of rods 130 appropriately and preferably adjustably mounted on the glue applicator carriers 120, 121. The tips of these rods 130 rest in the glue bath, are lifted up above the glue bath, a momentary pause occurs for the glue to drip off so that only a small amount of glue is left at the tip of each of the rods 130, the rods are moved over the outer edges of the panel 77, 72, 78, 73 and moved down to touch these outer edges and then moved back and into the glue bath in order to be ready for the next operation.

The movement of the blank by the mandrel 41 causes the bottom of the mandrel 41 first to engage the blank section 41*a* and move it down. The arrangement of the folding guides 60–63 is such and the arrangement of the panel supports is such that front panel 70 is folded up first, rear panel 71 is folded up next, the side panels 75, 76 fold in first, the side panels 77, 78 fold in next and the outer panels 72, 73 fold in last. The movement of the blank, as shown in FIGS. 3 and 4, through the device now causes the glue spots which have been deposited on the inside surface of panels 77 and 78 to engage the outer surface of panels 75 and 76, respectively, and the glue spots 151, which have been deposited on the outer edges of panels 72 and 73 to engage the outside of the side panels 77–75 and 76–78. The compression rollers 50, 51 spread the glue spots as they are squeezed against the panels and cause the glue to adhere so that the completed blank 52 which falls down onto the conveyor indicated generally by the arrow 52*a* will now be held appropriately. Only those portions of the glue applicator which constitute part of this invention have been described in particular. The specific operation of glue application is one which is well known in the art.

In the folding up of the carton, it is important to be certain that the panels containing the glue are folded in after the panels on which glue is not applied so that the glue applied to the inner surfaces of the panels containing the glue will be on the outside and thus engage and interconnect the panels on each side. If this were not so, it would be possible for the panels containing the glue to be folded in first and engage the mandrel, which is a highly undesirable situation.

In order to make certain the order of folding is that shown in FIG. 8, the machine is provided with a target 101 (see FIGS. 2, 3, 5 and 8). The target 101 is supported on the vertical bar 102 which is pivotally mounted on the pin 103. The bar 102 is held in the position shown in FIG. 2, but may be rotated counterclockwise with respect to the position shown in FIG. 2. The target 101 is secured to the vertical support 102 by the coil spring 105.

When, as seen in FIG. 3, the blank begins its fold, the panel section 70 engages the target 101 and, owing to the springs 105 and the additional spring 106 which resists movement of the vertical support 102, the panel section 70 of FIG. 3 is held back during the initial movement of the plunger 41. This produces the result shown in FIG. 8 where the side walls extending from the panel section 70, are caused to fold in first toward the mandrel and the side walls of panel section 71 which have received the glue as shown in FIG. 5 are folded so that they extend on the outside of the panels of panel section 70 (see also FIG. 7) so that the glue on the inner surface of the panels extending from panel section 71 will engage the outer surface of the panels extending from panel section 70.

By this means, therefore, a simplified and automatic means in provided to ensure the order of folding of the panels so that the inner surface of the panels which have received the glue will engage the outer surfaces of the panels which have not received the glue and, thereby, ensure the correct erection of the container. As the carton is pushed through the die by the mandrel, the carton disengages the target 101; and the target 101 springs back to a position where it can operate on the next carton.

Figure 1:
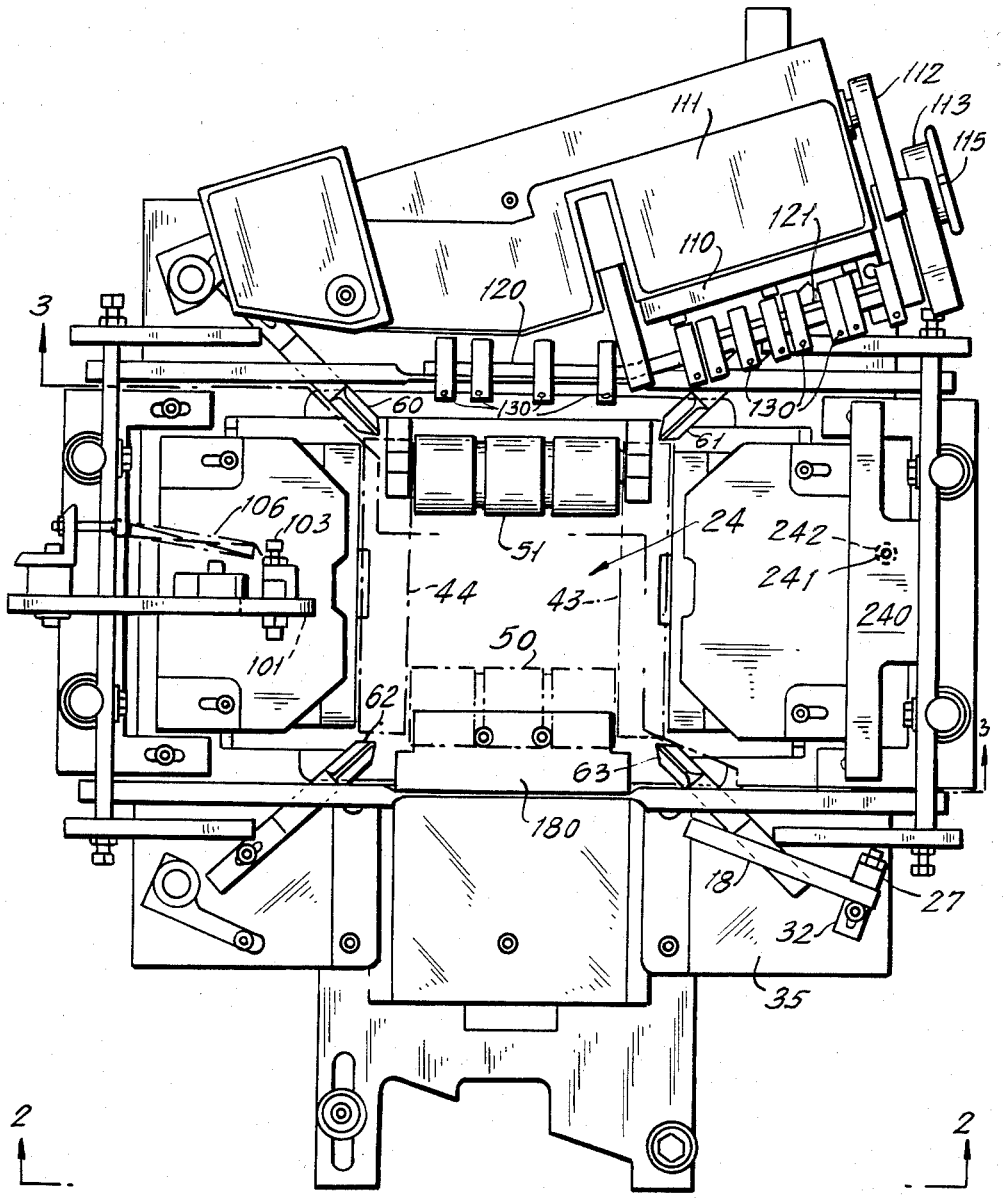
FIG. 1 is a top plan view showing the basic elements of the machine of the present invention looking down at the die but the view being taken just below the male mandrel which enters the die.
Figure 2:
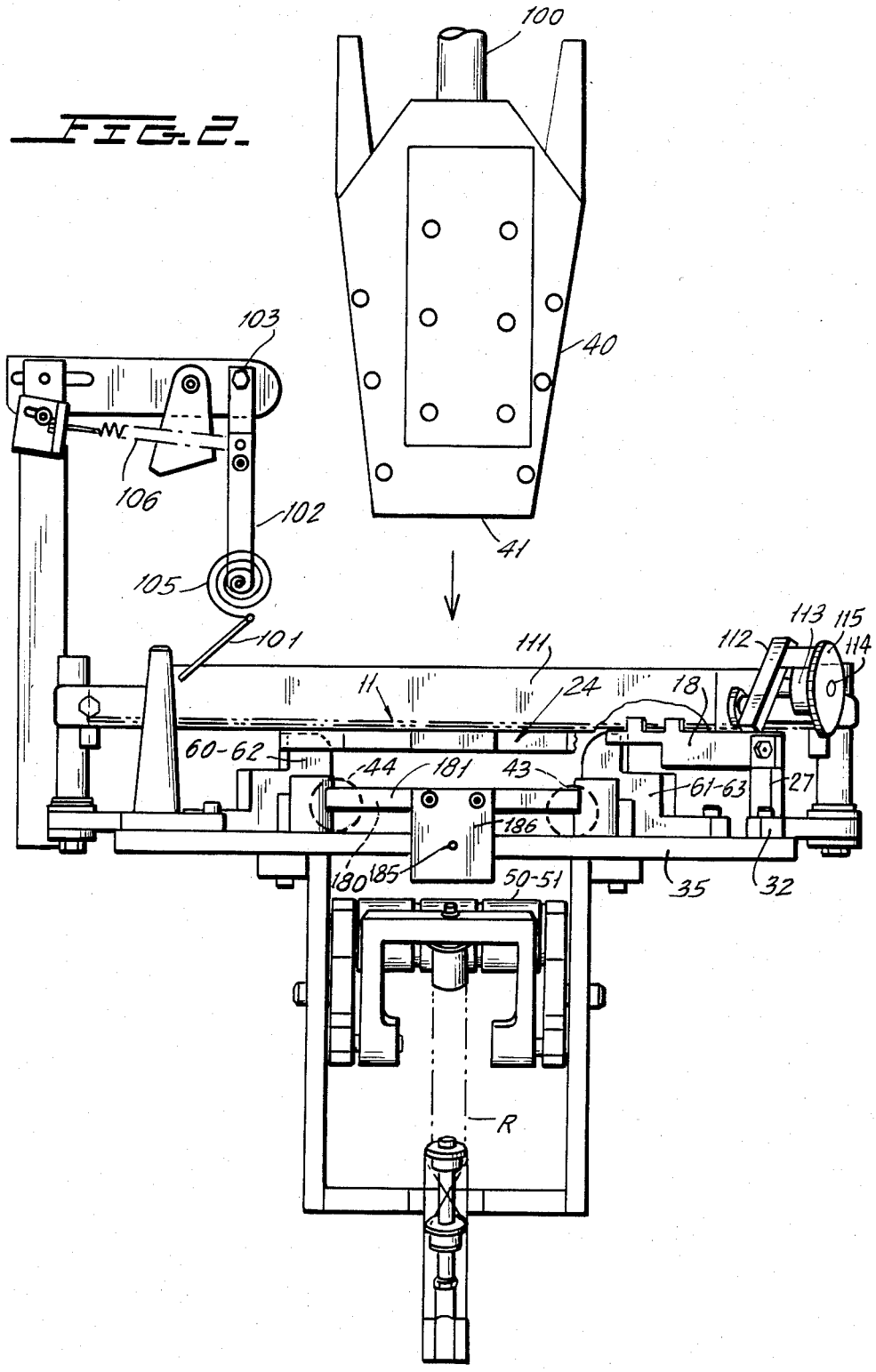
FIG. 2 is a side view of the machine shown in FIG. 1, taken from 2—2 of FIG. 1, looking in the direction of the arrows, showing the mandrel above the die with the devices arranged so that the mandrel is about to come down, the paper blank having been deposited on the support immediately above the die.
Figure 9:
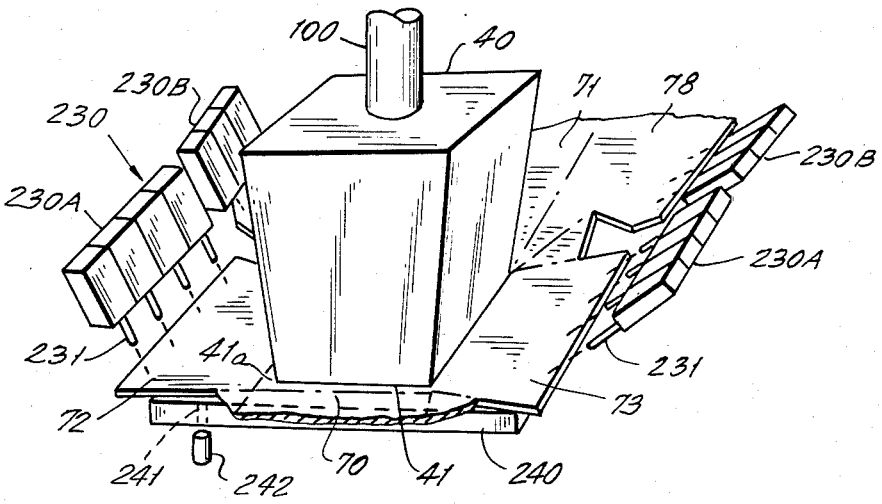
FIG. 9 is a schematic view in perspective showing an alternate method of applying glue to the appropriate edges of the carton.

In FIG. 9, there is shown an alternate method of applying glue which may replace the method shown schematically in FIG. 5 and indicated also at the elements 130 in FIGS. 1 and 3. In this case, a plurality of extruders 230 is provided in at least a pair of banks 230A and 230B on each guide. The bank of extruders 230A extends in a direction to apply glue to the inner surface of a vertical edge of an outer panel on one side and the bank of extruders 230B is arranged to apply glue to a panel extending from the bottom wall of the container.

An appropriate glue source is connected to each of the extruders 230 and on an appropriate signal will express the glue from the tips 231 of the extruders 230 onto the edge of the blank. The extruders are arranged so that the tips 231 lie just outside the path of folding of the carton and, thus, the extrusion must be under sufficient force to ensure that a drop of glue is projected onto the margin of the carton, as shown in FIG. 9.

In order to further ensure that the extrusion of glue occurs at the right time, immediately upon placement of the carton on the support frame, the rear surface 240 of the frame which supports the entire carton when it is first fed into the machine is provided with an opening 241 and a photosensitive unit 242 (FIG. 9) is located just beneath the opening 241 receiving light from a source, not shown, above the opening 242.

If necessary or desirable for automatic dust excluding purposes, the photosensitive unit may be above the frame and the light source may be located at the position shown at 242 for the photosensitive unit in FIG. 9—a reversal of parts.

When the blank is dropped down on the support frame, the opening 241 is covered, thereby interrupting the light to the photosensitive unit 242 and providing the appropriate signal for the extruders 230 to operate to extrude glue onto the margins of the carton as indicated in FIG. 9.

After the glue source has heated up properly and is ready to operate so that the glue has a predictable rate of flow, this alternate method shown in connection with FIG. 9 becomes a more positive and rapid way of applying glue without waiting for the droplets to be removed from the pins 130 of the glue applicator of FIGS. 1 to 6. Each method may have its own advantages in that the amount of glue utilized in connection with the pins 130 of FIGS. 1 to 6, will be a minimal amount while the timing of the application of glue in connection with the structure shown in FIG. 9 will be more accurate and rapid to achieve higher volume production.

Figures 10, 11, 12:
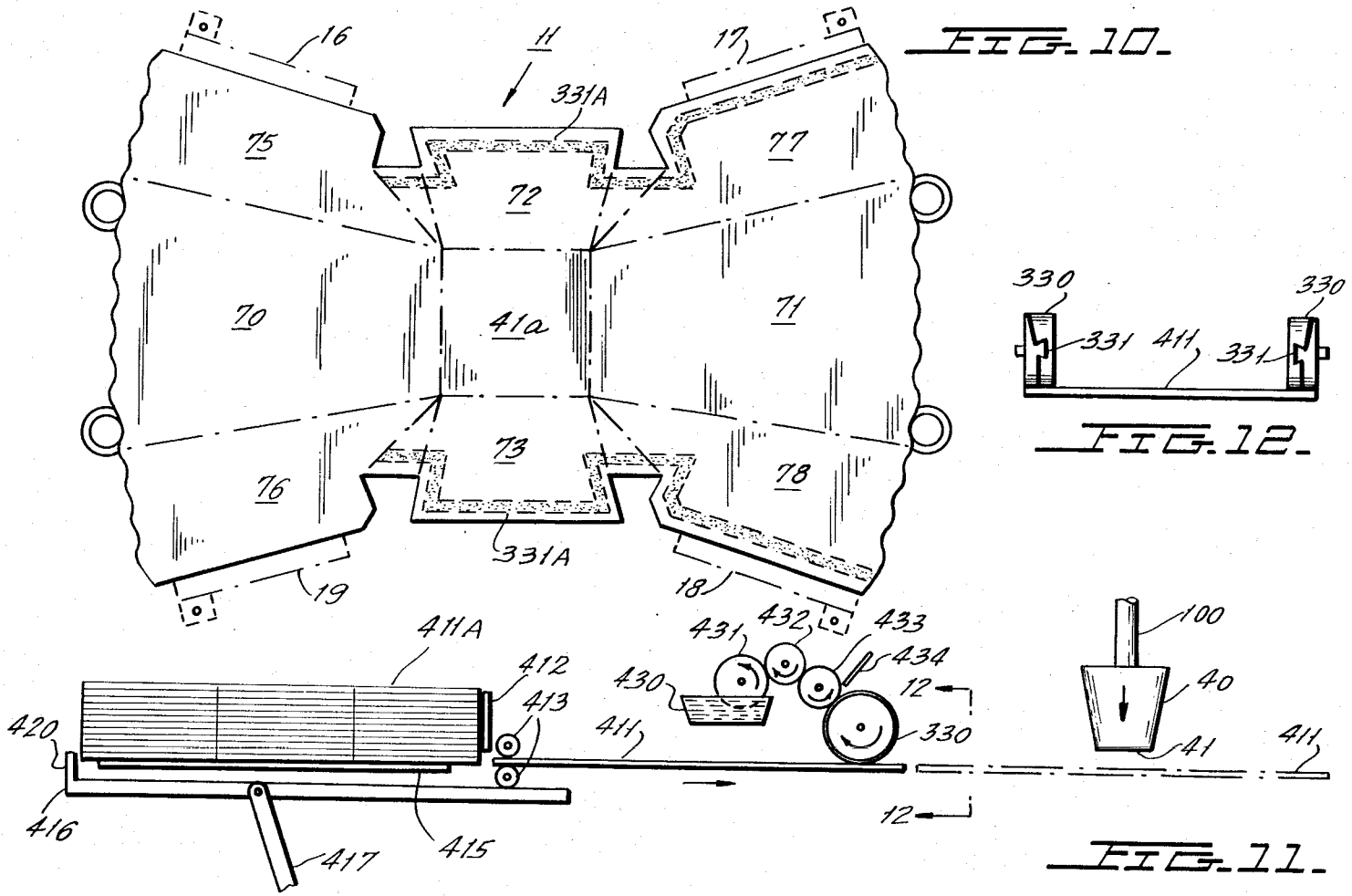
FIG. 10 is a plan view of the carton showing an additional alternate method of applying glue to the carton prior to its folding up.
FIG. 11 is a schematic view showing the method of operation of the device where the glue application method of at FIG. 10 is used.
FIG. 12 is a view in section taken from line 12—12 of FIG. 11, looking in the direction of the arrows.

In FIGS. 10, 11 and 12, there is shown an alternate method of applying glue by means of a glue roller 330 which in developed form has an embossed glue applicating surface 331 (see FIG. 12) which matches the glue stripe 331A which is to be applied to the blank. In this case, there must be relative movement between the glue rollers 330 on each side and the blank 11. Therefore, the method of feeding the blank 11 into the mechanism must be varied from that shown in connection with FIGS. 1 to 6 wherein the blank is taken from the bottom of a stack and dropped on to the table support. In this case, the blank 411, as seen in FIGS. 11 and 12, may be fed from a stack 411A where the front of the blank is held back by the front guide 412. The front guide 412 extends down to where a gap 413 is provided between the bottom of the guide 412 and the surface of the mechanism so that the bottom blank may be fed out from the stack support 415 by the reciprocating kicker 416 operated in reciprocating fashion by the reciprocating crank 417. Such kickers are well known in the field and require no further description here.

Once the bottom blank has been fed out slightly by the kicker 416, it may pass between feed rolls 413 which can assist or complete the operation. It should be kept in mind that the operative slat 420 of the kicker 416 may be comb-shaped and the support 415 similarly comb-shaped to permit the kicker to interact with and, in fact, pass through the plate 415. The movement of the kicker plate 416 and its operating slat 420 need be of limited degree since the blank may be picked up by the rollers 413 and fed out further.

The blank 411 is fed beneath the glue rolls 330 which, because of this embossed glue applicator elements 331, apply the glue stripe 331A. It is then fed to a stop position where it may be operated on by the plunger 41 in the manner described in connection with FIGS. 1 to 6. The glue applicators 330 are provided on each side and they operate from a glue pot 430 having a glue pick-up roll 431, glue transfer rolls 432, 433 and a doctor blade 434, which will smooth out the film of glue and predetermine the amount of glue which is to be applied to the glue applicator roll 330. The glue applicator roll 330 must, of course, be timed to start and stop in such manner that the beginning of the boss 331 on the roll which will apply the glue stripe 331A will be set to apply this glue stripe starting at the leading edge of the carton blank.

The utilization of such a glue applicator roll may be indicated where the cartons are used to contain fluid materials, or materials which may otherwise leak or drip. In the usual case, where the carton is intended to contain popcorn, the type of glue application shown in FIGS. 10, 11 and 12 is not necessary since the carton must merely be held together and the popcorn be contained. Where, however, there are some highly fluid materials mixed in with the popcorn, or other fluid materials of any kind which are to be contained by the carton, then the glue applicator structure of FIGS. 10 to 12 may be used. It should be noted that when the blank in the structure of FIGS. 10 to 12 reaches the mandrel 41, the folding operation is identical with that shown in FIGS. 1 to 6.

It should be borne in mind that the light sensitive element 242 and the corresponding opening 241 may be used in order to initiate the operation of the glue applicators of FIGS. 1 to 6 and may also be used to operate means for rotating the glue applying roller 330 to its "start" position when the blank reaches a position just below the mandrel 41 of FIG. 11, so that the glue applying roller 330 will be ready for the next blank.

In the foregoing, the present invention has been described solely in connection with a preferred illustrative embodiment thereof. Since many variations and modification of the present invention will now be obvious to those skilled in the art, it is preferred that the scope of the present invention be determined not by the specific disclosures herein contained, but only by the appended claims.

What is claimed is:

1. A machine for making a tapered nestable container from a blank, said container having front and back walls and side walls with side panels extending from each side of the front and back walls;

said machine comprising a tapered mandrel male member, the inner dimension of which matches the inner dimension of the container to be formed from the blank, and having a bottom section matching the bottom wall of the blank;

a die; support and guide arranged above the die in horizontal position with respect thereto; said mandrel having a vertical movement into the die and said die having a horizontal position;

said blank being positioned on said support and guide members prior to movement of said mandrel into said die;

means being provided for applying adhesive to outer portions of sections of the blank, said mandrel moving downwardly into the die driving the blank through the die after said adhesive has been applied; and said means for applying adhesive comprising movable carrier members having a plurality of pins extending therefrom; said pins being arranged along the contour of the blank adjacent the edge of the blank and adjacent the inner surfaces of the outer edges of the panels which are to be bolded on the outside of the additional panels of the blank;

said pins extending on each side of the carton blank and a glue pot adjacent said pins; said pins being movable from a position where their ends are inserted into said glue pot to a position where their ends extend adjacent the surface of the blank, and being moveable from the glue pot to the blank when the blank is in position to receive glue from the pins and being movable back before the next blank is placed in position.

2. A machine for making a tapered nestable container from a blank, said container having front and back walls and side walls with side panels extending from each side of the front and back walls;

said machine comprising a tapered mandrel male member, the inner dimension of which matches the inner dimension of the container to be formed from the blank, and having a bottom section matching the bottom wall of the blank;

a die; support and guide arranged above the die in horizontal position with respect thereto; said mandrel having a vertical movement into the die and said die having a horizontal position;

said blank being positioned on said support and guide members prior to movement of said mandrel into said die;

means being provided for applying adhesive to outer portions of sections of the blank, said mandrel moving downwardly into the die driving the blank through the die after said adhesive has been applied;

said adhesive being applied on the inner surface of the edges of the panels of the blank extending from a front wall thereof and means for ensuring that in the folding up of the blank by the operation of the mandrel that said panels extending from the front wall will extend on the outer surface of the corresponding panels extending from the rear wall and that corresponding panels extending from the bottom wall will extend inside the panels extending from the front wall;

said means for ensuring that the front wall panels will extend outside said rear wall panels comprising a member engaging the rear wall of the blank during part of the movement of the mandrel in order to retard the upward folding of the rear wall with respect to the blank and thereby cause the side panels extending therefrom to fold in first so that the panels extending from the front will be outside the panel extending from the rear wall;

said engaging member is resiliently mounted to apply biasing non-rigid pressure to said rear wall of said blank.

* * * * *